US005217380A

United States Patent [19]

Martinet

[11] Patent Number: 5,217,380

[45] Date of Patent: Jun. 8, 1993

[54] METHOD OF TEACHING THE POSITIONING OF A GOLFER'S HANDS ON A GOLF CLUB

[76] Inventor: Gary S. Martinet, 917 Oak Forest Dr., Winter Springs, Fla. 32708

[21] Appl. No.: 852,035

[22] Filed: Mar. 16, 1992

[51] Int. Cl.[5] ..... A63B 69/36

[52] U.S. Cl. ..... 434/252; 273/187.5; 273/81.4; 273/81 B; 273/163 A

[58] Field of Search ..... 273/81 B, 187.4, 187.5, 273/81 D, 81.4, 163 A, 163 R, 164.1; 434/252; 273/81 D, 81.4, 163 A, 163 R, 164.1

[56] References Cited

U.S. PATENT DOCUMENTS 4,116,440 9/1978 Takeshima ..... 273/81.4
4,186,924 2/1980 Southey ..... 273/81 B
4,629,191 12/1986 Mancuso ..... 273/81.4

*Primary Examiner*—George J. Marlo
*Attorney, Agent, or Firm*—James H. Beusse

[57] ABSTRACT

An innovative teaching process for instruction of the proper placement of the hands on the grip of a golf club using a sequence of golf grips of increasingly greater numbers of flat, longitudinal surfaces incorporates successively less detectable, yet consistently located tactile feedback producing ribs on the golf grip. Teaching starts with a maximum biomechanical feedback grip with ribs that are pronounced. As the golfer develops sufficient proficiency with locating the hands on the grip and maintaining this proper hand positioning through the swing, the maximum biomechanical feedback grip is replaced with a new grip with less pronounced ribs, typically, with the same spacing as the first used grip. This process is repeated until the golfer has advanced from a maximum feedback grip to a minimum biomechanical feedback grip, i.e., to a substantially circular grip as accepted for USGA golf play. In one form, the grip, generally circular in nature, has from five to nine internal ribs. These multiple ribs extend along the axis of the grip from one end to the other so as to substantially cover the grip. The ribs serve as a biomechanical feedback mechanism to calibrate the golfer's presentation of the club face to the ball at impact and the multiple ribs serve to sufficiently improve the grip on the club during the swing, thereby sustaining the calibrated presentation of the club face during contact with the ball.

6 Claims, 2 Drawing Sheets

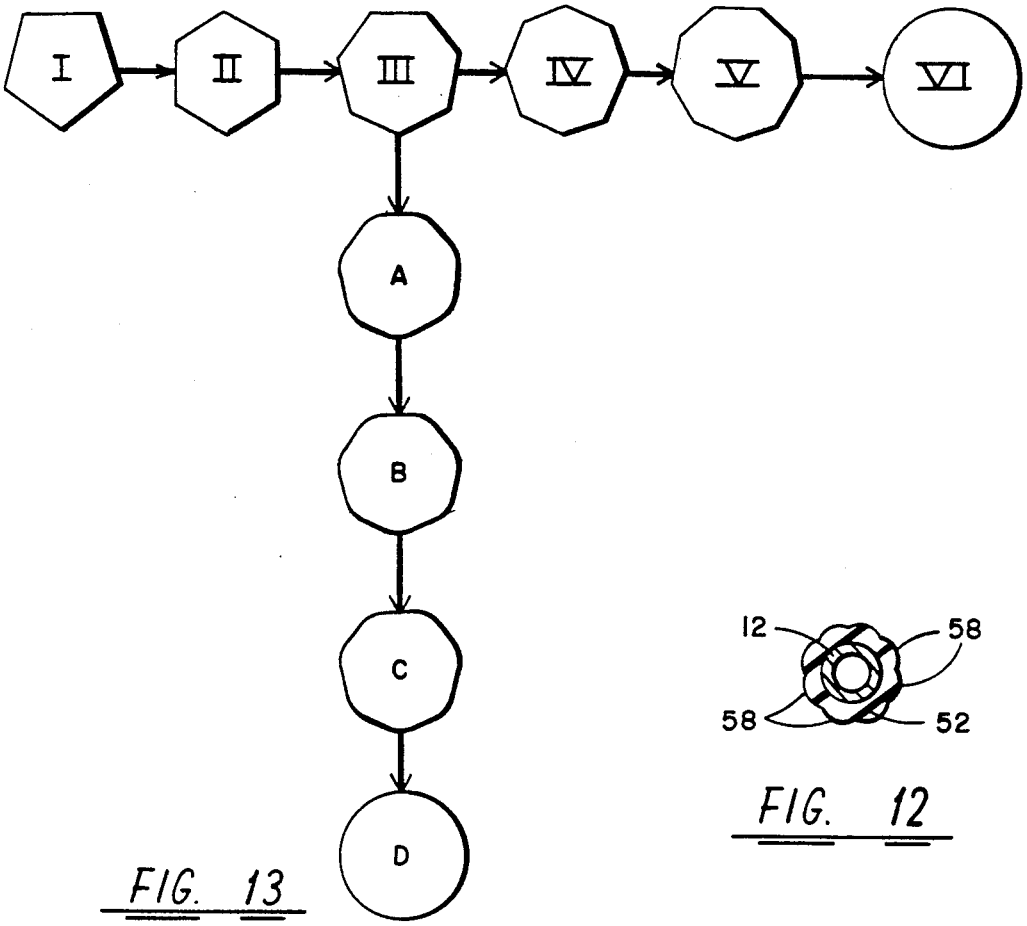
FIG. 13
FIG. 12
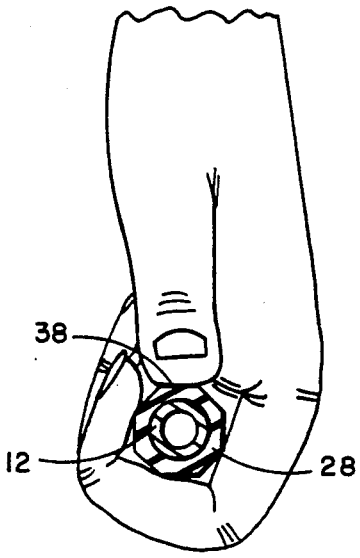
FIG. 8
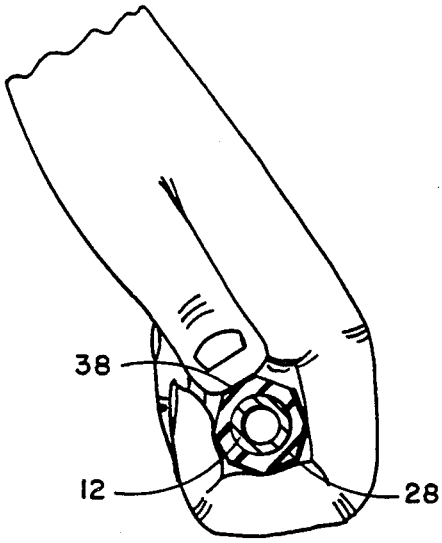
FIG. 10

METHOD OF TEACHING THE POSITIONING OF A GOLFER'S HANDS ON A GOLF CLUB

The present invention relates to golf and, more particularly, to a method for teaching consistency in gripping of a golf club.

BACKGROUND OF THE INVENTION

Golf club grips as a whole today are an integral part of the golf club, serving as the interface between the club and the player. Golf is a complicated game, requiring excellent hand-eye coordination that eventually must be transmitted through the grip to the club and eventually to the ball at impact. A proper grip then serves as a key component to the success and enjoyment of players in the game.

Today's grips offer virtually no tactile feedback to the player. Attempts have been made in the past to provide a golf club with a grip that will give the golfer assistance in hand placement. Examples of such proposed grips are shown in U.S. Pat. Nos. 3,219,348 and 4,629,191. These grips have focused narrowly on one style of grip that provides limited tactile feedback. While these grips may have utility in a practice setting, they do not meet standards of the United States Golf Association (USGA) and are therefore not acceptable for tournament play. Furthermore, while these grips provide tactile feedback, they do not provide for correction or adjustment of a golfer's grip so as to improve golfing skills.

SUMMARY OF THE INVENTION

The present invention is intended to overcome the deficiencies of the prior art and to provide a teaching method that addresses the fundamental problem of all golfers—repeatable positioning of the hands in the proper way on the grip and maintaining this position throughout the swing of the club. The present invention accomplishes this desirable result by using an innovative series of grips in a sequence as the golfer advances in proficiency. Initially, a golfer's hands are measured to determine key dimensions including, but not limited to, overall hand length, length of each finger, distance between the joints on each finger, diameter of each finger at the joints, width of the thumb, length of the palm, and width of the palm. These dimensions correlate to a first grip with circumferentially spaced lengthwise extending ribs or flats giving the most effective instructional tool. When the golfer exhibits sufficient proficiency with the first grip, the first grip is replaced with a second grip with ribs or flats that are specifically reduced in tactile feedback. The exercises are repeated until sufficient proficiency is again attained, and the replacement process is repeated until a grip that is substantially circular in nature is effectively in use by the golfer.

Preferably, the grips include from five up to and including nine internal ribs or from five up to and including nine external flat gripping surfaces that extend over the length of the grip along the lengthwise axis. Unique to the application of these grips, and principal to the innovative instructional process, is the alignment of one of the edges of the flat surfaces to the face of the club, offset from 0° to ±36° for a five sided grip and offset from 0° to ±20° for a nine sided grip, with the six, seven, and eight sided grips equivalently offset. Through the teaching process, the instructor will determine the number of degrees of offset required to create a proper swing path to produce the desired results.

BRIEF DESCRIPTION OF THE DRAWINGS

Serving to illustrate the invention, there is shown in the accompanying drawings figures which are presently preferred; it being understood that the teaching process and the product discussed herein are not to be limited to the precise arrangements and devices shown in which:

FIG. 8 is a cross-sectional view of the grip shown in FIG. 4., and attached as shown in FIG. 6 to the club shaft, of the invention and showing how the grip would be held in one teaching instance in the golfer's hand in the instructional process;

FIG. 10 is a cross-sectional view of the grip shown in FIG. 4, and attached as shown in FIG. 8 to the club shaft, of the invention and showing how the grip would be held in one teaching instance in the golfer's hand in the instructional process;

FIG. 12 is a cross-sectional view of the alternate construction grip from FIG. 10 as applied to a typical golf club shaft; and FIG. 13 is a cross-sectional diagrammatic view illustrating successions or progressions of grips as may be successively utilized in a method of teaching the positioning of a golfer's hands on a golf club with each successive grip having a greater number of sides or ribs than a preceding one of the grips and with the last grip in each grip progression being substantially round.

DETAILED DESCRIPTION OF THE INVENTION

Figure 1:
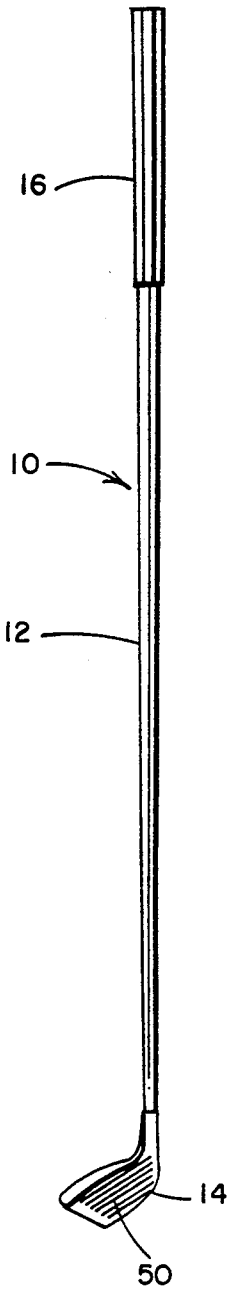
FIG. 1 is a side elevational view of a golf club with a grip fabricated in agreement with the principles employed in this invention and assembled to the club shaft in a manner suitable for the new instruction process.
Figure 2:
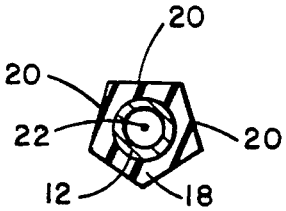
FIG. 2 is a cross-sectional view showing a first embodiment of the product used in the teaching process, a five sided grip.
Figure 3:
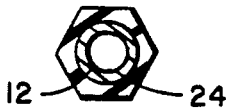
FIG. 3 is a cross-sectional view showing another embodiment of the product used in the teaching process, a six sided grip.
Figure 4:
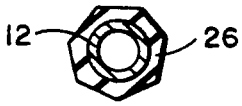
FIG. 4 is a cross-sectional view showing another embodiment of the product used in the teaching process, a seven sided grip.
Figure 5:
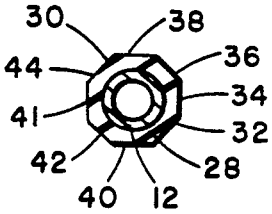
FIG. 5 is a cross-sectional view showing another embodiment of the product used in the teaching process, an eight sided grip.
Figure 6:
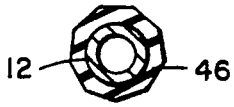
FIG. 6 is a cross-sectional view showing another embodiment of the product used in the teaching process, a nine sided grip.
Figure 7:
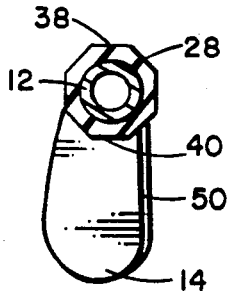
FIG. 7 is a cross-sectional view showing the grip from FIG. 4 as attached to a club shaft and aligned in one manner with the club head and front of the club shaft.

Referring now the drawings in detail and noting that like reference numbers are used throughout all of the various figures to indicate like elements, FIG. 1 illustrates a golf club 10 having a shaft 12, a club head 14 and a grip 16. FIGS. 2–6 illustrate various forms of an innovative grip which can be used for grip 16. FIG. 2 depicts a first construction of a progressive grip 18 used in the present teaching invention method in which the grip is formed with five uniformly spaced sides or flats 20. Each of the FIGS. 2–12 are taken as cross-sectional views normal to an axis 22 of the shaft 12 and corresponding grip. In each case, the ribs and/or flats are preferably uniformly circumferentially spaced about the associated grip, e.g., grip 16. FIG. 3 shows the shaft 12 fitted to a six sided grip 24. FIG. 4 shows the shaft 12 with a seven sided grip 26, and FIG. 5 shows an eight sided grip 28 mounted on the shaft 12 with eight faces 30, 32, 34, 36, 38, 40, 41, and 42 extending longitudinally along the entire surface of the grip and defined by the circumferentially spaced ribs 44. Finally, FIG. 6 shows a nine sided grip 46 applied to the shaft 12 having nine circumferentially spaced ribs 44. FIGS. 2–6 thus illustrate a progression of multi-sided grips as constructed for use in the inventive teaching process with the appropriate grip chosen based on the anatomy, physical condition, and proficiency of the golfer. FIG. 7 illustrates how a grip is arranged on the shaft 12 and, in particular, details the coordination of the eight sided grip 28 as applied to the shaft 12. The grip 28 is affixed to the shaft 12 such that the face or flat 38 is perpendicular to the face 50 of club head 14. This arrangement of the grip is such that a golfer's thumb will rest squarely on the grip face 38 when the grip is held in a proper manner. It will be apparent that any of the grips, 18, 24, 26, 28, and 46, as well as others, may be affixed to a club shaft 12 so as to provide a flat surface perpendicular to a club head face 50 and therefore allow alignment of the golfer's hands to the club head face. FIG. 8 illustrates the normal, proper positioning of the golfer's hands on the eight sided grip 28 with thumb squarely positioned on the face 38 of the grip.

Figure 9:
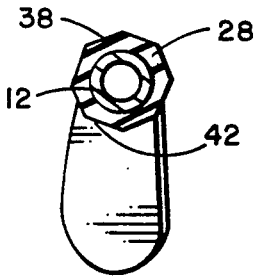
FIG. 9 is a cross-sectional view showing the grip from FIG. 4 as attached to a club shaft and aligned in another manner with the club head and front of the club shaft.

The normal position of the golfer's hand, as shown in FIG. 8 may not enable some golfers to strike a ball such that a desired line of flight of the ball is achieved. In some cases, an anatomical deficiency, whether genetically induced, caused by injury or disease, or simply a non-correctable habit on the part of the golfer regarding the proper club grip and subsequent swing of the club will prevent the golfer from striking the ball properly. Accordingly, it may be desirable to affix a grip to a club such that the thumb positioning surface, such as surface 38, is angularly offset from the normal position of FIG. 7. Referring to FIGS. 9 and 10, there is shown an angularly offset grip position in which surface 38 has been rotated counterclockwise. The grip position, shown in FIG. 10, is commonly referred to as a strong grip. In general, such a grip will result in a "hooked" ball flight if a normal swing and follow-through are made. This grip position is therefore of use in correcting a "sliced" ball flight path since rotation of the golfer's hands during the swing will tend to close the club face at the ball impact point. While it is important for the teaching professional to be able to vary the position of the golfer's hands on the grip, it is of more importance that the golfer be able to consistently position his/her hands on the grip in the same position. One advantage of the present invention is that the grips may be affixed to the club shafts at various angular orientations to accommodate individual golfers and provide a reference surface to enable each golfer to "feel" when his/her hands are properly positioned.

Figure 11:
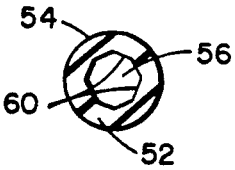
FIG. 11 is a cross-sectional view of the invention with an alternate construction that causes minimization of the ribs when affixed to a club shaft.

FIG. 11 illustrates construction of a grip 52 having a generally round outer gripping surface 54 with a preformed eight sided cavity 56 running longitudinally within the grip. When this grip 52 is installed on the shaft 12, ribs 58 (exaggerated in FIG. 12) are developed on the outer surface of the grip. The ribs may extend about 0.065 inch above the outer surface 54 and, while generally not visible, can be felt when the hand is positioned on the grip. This construction represents one method of achieving an effective biomechanical feedback for the student. It is believed that the minimal ribs comply with USGA rules.

The grip of FIGS. 11 and 12 is believed unique in providing a method of assembling a hand grip on a shaft 12 of a golf club 10 with multiple, circumferentially spaced ribs or ridges 58 which are generally not visible. The shaft 12 has at least an end section of a generally cylindric configuration. The hand grip 52 has a preselected length and includes a set of internal surfaces 60 each having a preselected configuration with adjacent internal surfaces intersecting each other generally lengthwise of the hand grip. The hand grip has an external surface 54 having a generally cylindric configuration prior to assembling on the shaft. The hand grip 52 is fitted onto the at least one end section of the shaft 12 such that the preselected configuration of the internal surfaces of the grip conform to the generally cylindric configuration of the shaft. This results in deforming at least the internal surfaces of the grip. A set of ridges 58 in the generally cylindric configuration of the external surface extending at least in part generally lengthwise of the grip 52 are formed in response to the deforming of the internal surfaces 60 of the grip. The ridges are located generally at the intersection of the adjacent internal surfaces.

As described above, the purpose of the present invention is to enable the golfer to learn to properly position his/her hands on a golf grip. In initiating the teaching process, the golf pro is normally called upon to select a grip which fits the hand of the golfer. This selection process may be simply a matter of determining the size of the golfer's hand and then identifying which of the above described grips best fits the hand. For example, the five sided grip has larger flat areas that may be more appropriate for the golfer having very large hands. Conversely, the golfer having very small hands may be more comfortably fitted initially with a grip having six sides and therefore smaller flat areas. Once a particular grip has been selected by the golfing pro for use by the golfer, the next step in the process is to allow the golfer to swing the club with the selected grip and determine from the golfer's particular grip on the club the action of the ball when struck by the club. Typically, the beginning golfer or even the golfer with some limited degree of experience will exhibit a tendency to either slice or hook the golf ball which, of course, is effected by the deviation of the club head leading edge from the desired position when the golf club is swung by the golfer, as well known in the art. The professional can effect the correction of this tendency by shifting the position of the hands on the golf grip until a position is found which allows the golfer to relatively consistently hit normally acceptable shots. For example, the pro may gradually allow the golfer's hands to be rotated clockwise about the grip in order to correct a slice problem.

Once the professional has found a position of the golfer's hands on the grip which tends to produce relatively consistent and desirable results when the ball is properly struck, the professional will prepare a club having a multi-sided grip positioned in a preselected circumferential location about the shaft with respect to the club head leading edge such that the golfer will have an acceptable grip with a thumb aligned on a flat surface as shown in FIGS. 8 and 10. The grip will cause the golfer to automatically properly align his/her hands in a preselected position on the golf club so as to consistently hit a desired shot. More particularly, the grip 28 on the club 10 will be so aligned that the golfer's thumb is desirably positioned or repositioned on a flat side 38 of the grip so that the golfer will also have a finger feel for the proper position of his/her hands on the golf club.

The golfer is then encouraged to continue to practice with the initial selected grip and the initial selected position until such time as the golfer feels that he/she can consistently grasp the club in the same position and strike the ball and obtain a consistent direction of ball flight. Once the golfer feels that he/she has obtained such consistency, the professional then regrips or changes the grip on the club to one of more sides or to one having ribs or ridges 58 and again allows the golfer to become accustomed to that particular grip. This process can then be repeated as many times as is necessary to allow the golfer to progress to a grip which may be round or which may have internal indicia or ribs which can be felt by the golfer but are not necessarily visible to allow him/her to consistently grasp the club in the same manner using tactile feedback. The indicia may be a single reminder rib of a type presently available or may comprise multiple reminders of the type described herein. In either case, the purpose of the repeated changes from the five or six sided grip to one approaching a round grip is gradually weaning the golfer from the multi-sided grip which easily aligns his/her hands on the club to one which is approved by the USGA. However, the procedure may involve stepping directly from a first multi-sided grip to a round grip or stepping sequentially through various selected multi-sided grips, including occasionally stepping back to grips of fewer sides, all dependent upon the golfer's skill and ability to learn proper hand positioning. The procedure may also include stepping from a multisided grip to a grip such as 52 having reminder ribs. In this latter instance, the number of ribs can be changed or the height of the ribs can be changed as the golfer progresses. FIG. 13 schematically illustrates this progressive development. At any point in progressing from a grip of few sides toward a uniformly round grip (grips I–VI), the process may be diverted toward grips having ribs rather than flats as shown by grips A–D.

To reiterate, the professional first places the golfer with a grip which the golfer can easily feel so that the golfer becomes familiar with the proper position of the hands on the grip. Thereafter, as the golfer becomes more proficient in swinging the club and in grasping the grip upon initial set-up, the professional will change the grip to one having more sides or having ribs until eventually the golfer is comfortable with utilization of a round grip approved by the USGA. The golfer may eventually elect to use a commercially available reminder grip having a single reminder ridge running down an underpart of the grip or the golfer may be provided with a grip having multiple reminder ribs running longitudinally of the grip, such as shown in FIG. 12, to enable him/her to more accurately position his/her hands on the grip.

The present invention may be embodied in other specific forms without departing from the spirit or essential attributes thereof and accordingly reference should be made to the appended claims rather than to the foregoing specification as indicating the scope of the invention.

What is claimed is:

1. A method of teaching the positioning of a golfer's hands with respect to a grip arranged on the shaft of a golf club in aligned relation with a leading edge of a head secured to the shaft, the grip having a gripping surface including a plurality of generally radially outwardly deformed protuberances arranged generally in side-by-side relation and extending generally lengthwise of the grip with respect to the shaft, the method comprising the steps of:

placing the golfer's hands on the grip in a desired position to ascertain the deviation of the leading edge on the head of the golf club from a desired position when it is swung by the golfer;

establishing the feel of a thumb position for the golfer's hands with respect to at least one of the deformed protuberances and the feel of finger positions for the golfer's hands with respect to at least some of the others of the deformed protuberances in response to the placing step;

regripping the shaft with another grip like the first named grip;

disposing the another grip in a circumferentially rotated position on the shaft to establish a new position of the deformed protuberances on the another grip in response to the regripping step thereby to compensate for the deviation from the desired position of the leading edge of the golf club ascertained during the placing step; and repositioning the golfer's thumb on the at least one deformed protuberance in the new position of the deformed protuberances for attaining the desired position of the leading edge on the head of the golf club when it is subsequently swung by the golfer.

2. The method as set forth in claim 1 further comprising the additional steps of further regripping the shaft with still another grip having a greater number of the deformed protuberances also disposed in the new position and repeating the repositioning step until the leading edge on the head of the golf club attains the desired position when the golf club is swung by the golfer.

3. The method as set forth in claim 2 further comprising the further additional step of repeating the further regripping step until the golfer is consistently swinging a golf club having a substantially round grip while attaining the desired position of the club head leading edge.

4. A method of teaching the positioning of a golfer's hands on a golf club, the gold club having a shaft, a head secured to the shaft, a leading edge on the head, and a progression of grips for securement with the shaft to respectively define a plurality of deformed protuberances spaced generally circumferentially about the shaft so as to extend generally lengthwise thereof, and a successive one of the grips in the grip progression having a greater number of the deformed protuberances than a preceding one of the grips in the grip progression, the method comprising the steps of:

successively securing each grip in the grip progression to the shaft and arranging at least one of the deformed protuberances on each grip in a preselected circumferential location about the shaft with respect to the leading edge of the head on the golf club during the successively securing step; and placing the golfer's hands in a preselected position relative to the deformed protuberances on each grip upon its successive securement to the shaft and effecting a desired position of the leading edge on the head of the golf club in response to the placing step when the golf club is swung by the golfer.

5. The method as set forth in claim 4 wherein the placing step includes establishing a feel of a thumb position of the golfer's hands with respect to at least one of the deformed protuberances on each grip and a feel of finger positions of the golfer's hands with respect to at least some of the other of the deformed protuberances on each grip.

6. The method as set forth in claim 4 wherein the grip progression includes a substantially round grip and wherein the successively securing step includes further securing the substantially round grip to the shaft as the last grip in the grip progression, and wherein the method further comprises the additional step of arranging the golfer's hands in the preselected position on the round grip until the golfer is consistently swinging the golf club to effect the desired position of the leading edge on the head of the golf club.

* * * * *